US005971709A

United States Patent [19]

Hauser

[11] Patent Number: 5,971,709

[45] Date of Patent: Oct. 26, 1999

[54] RADIATOR FAN FOR INTERNAL COMBUSTION ENGINES

[75] Inventor: Kurt Hauser, Suessen, Germany

[73] Assignee: BEHR GmbH & Co., Stuttgart, Germany

[21] Appl. No.: 09/041,722

[22] Filed: Mar. 13, 1998

[30] Foreign Application Priority Data

Mar. 14, 1997 [DE] Germany ..... 197 10 606

[51] Int. Cl.[6] ..... B63H 1/26

[52] U.S. Cl. ..... 416/175; 416/169 A; 416/188; 416/241 A; 416/203; 415/208.1

[58] Field of Search ..... 415/208.1, 211.1; 416/169 A, 188, 241 A, 175, 180, 189, 203; 264/328.2

[56] References Cited

U.S. PATENT DOCUMENTS

| | | | |
|---|---|---|---|
| 4,169,693 | 10/1979 | Brubaker | 416/93 R |
| 4,384,824 | 5/1983 | Woods | 416/169 A |
| 5,193,608 | 3/1993 | Sekine et al. | 165/41 |

FOREIGN PATENT DOCUMENTS

| | | |
|---|---|---|
| 462853 | 11/1927 | Germany . |
| 94 03 217 | 8/1995 | Germany . |
| 195 00 994 | 7/1996 | Germany . |
| 196 34 091 | 3/1997 | Germany . |
| 63202 | 9/1913 | Switzerland . |
| 672531 | 11/1989 | Switzerland . |

*Primary Examiner*—Edward K. Look
*Assistant Examiner*—Ninh Nguyen
*Attorney, Agent, or Firm*—Foley & Lardner

[57] ABSTRACT

A radiator fan of an internal combustion engine in a motor vehicle is provided in the form of a one piece injection molded combination of radial fan blades and axial fan blades supported on a conical annulus for increasing air pressure flow across the radiator. The conical annulus has the same axis as that of the hub of the fan. The radial blades connect the interior face of the conical annulus to the hub of the fan. The axial blades are connected to the exterior surface of the conical annulus and extend radially outward. The fan is coupled to the engine through a fluid friction clutch. An air guide ring is positioned upstream of the fan for deflecting axial incoming air flow to help improving efficiency of the fan.

22 Claims, 7 Drawing Sheets

21
1
7
II
8a
III
24
12
6
8b
8
15
r
18
10
16
13
17
14
9
α
11
23
Ü
20
4
5
2
19
3
R
ICE
a
a

RADIATOR FAN FOR INTERNAL COMBUSTION ENGINES

BACKGROUND OF THE INVENTION

1. Field of the Invention

The invention relates to a fan, in particular a fan for radiators of internal-combustion engines in motor vehicles.

2. Description of Related Art

A conventional fan having inner radial blades and nouter semi-axial blades is disclosed in Swiss Patent 63 202. The entirety of a conical hub supporting the axial blades is designed as a centrifugal fan or radial blower. An object of the Swiss patent was to provide an axial fan without a so-called center cup, i.e. a hub through which axial flow can occur. Because a recirculation flow forms in such a hub, the inner region of this known axial fan incorporates the radial blower. In the Swiss patent, the leading edges of the radial and axial blades are flush with one another. At the outflow region of the radial blower, an outlet parallel to the axis of rotation is provided by a deflection in the blade passages. The fan disclosed in the Swiss patent is driven directly via a shaft fastened to the centrifugal fan.

German Patent 94 03 217 discloses an axial fan having inner and outer axial blades separated by a coaxially running intermediate ring. The spacing between the outer axial blades is substantially smaller, or the blade number is correspondingly greater, than that of the inner axial blades. According to the German patent, an increased fan output is achieved.

One consequence of installing fans in motor vehicles behind the radiator of the internal-combustion engine and in front of the internal-combustion engine is that the fan, which is in principle designed as an axial fan, is subjected to relatively pronounced throttling. This produces a semi-axial flow as described in detail in the Behr company brochure entitled "Düsenmantellüfter für Nutzfahrzeugkühlanlagen" by Kurt Hauser, published in MTZ, Motortechnische Zeitschrift, Volume 53, No. 11/92.

SUMMARY OF THE INVENTION

An object of the embodiments of the present invention is to provide a fan that is adapted to optimize air movement through a radiator for various installations and operating states of an internal combustion engine. In particular, a fan according to the present invention provides increased air pressure.

According to preferred embodiments of the present invention, the inlet region of a set to radial blades is designed in such a way that the leading edges of the blades extend obliquely forward from a recessed hub end face. The length of the projecting blades relative to the hub produces a semi-axial air flow.

A considerable pressure increase is also achieved by the combination of radial and axial blades according to the present invention. According to preferred embodiments to the present invention, a radial blower is combined with an increased number of axial fan blades supported on a conical annulus.

Another advantage of embodiments of the present invention is that a fan combining sets of radial and axial blades can be manufactured as a one-piece injection-molded article. Thus, the present invention can be mass produced in a cost-effective manner. Another advantage of the present invention is that it is readily ejected from the injection mold by virtue of establishing a parting line on the radial blades, thus facilitating axial separation of the mold portions. According to the present invention, additionally parts for directing air flow are subsequently mounted and attached to the one-piece injection-molded sets of radial and axial blades.

In preferred embodiments of the invention, effective radial flow can be achieved without hindering production by providing the radial blades with curves in the direction of rotation at the intake region and a straight, radial orientation downstream from the intake region.

In preferred embodiments of the invention, air inflow is further improved by providing an air-guide ring in or upstream of the intake region of the radial blades. The air-guide ring deflects the otherwise axially directed incident air flow in a suitable manner to the radial blades and thus helps to improve the efficiency of the fan. The air-guide ring is particularly advantageous when a fluid friction coupling is fastened to the hub of the fan and drives the latter. Such couplings, which are known per se, generate heat in the interior as a result of constant slip. Therefore, cooling ribs, which are usually oriented radially, are arranged on the outside of the coupling. In the intake region of conventional fans, this results in a radially directed secondary flow from the coupling that interferes with the primary inflow of air to a fan. However, according to the present invention, the configuration of the leading edges of the radial blades in combination with the air-guide ring arranged in front of the fan provide a smooth merger between the primary air flow and the secondary flow off the coupling. Thus, additional advantages of the present invention include improved cooling of the coupling and improved efficiency of the fan.

In yet other preferred embodiments of the present invention, individual air-deflecting blades are advantageously distributed around the air outflow from the radial blades. The air-deflecting blades deflect air flow from the radial blade set in a roughly radial direction, toward the fan's axis of rotation. This is especially advantageous for the cooling of the rear side of the coupling and the front side of the engine. In conventional systems without the air-deflecting blades according to the present invention, the lack of air flow between the coupling and the engine causes a build-up of heat with a corresponding temperature increase for both the coupling and the engine. Such a build-up of heat is avoided by the air-deflecting blades according to the present invention inasmuch as air flow spirals inward toward The fan axis and then, shifted axially rearward, flows spirally outward again.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

Figure 1:
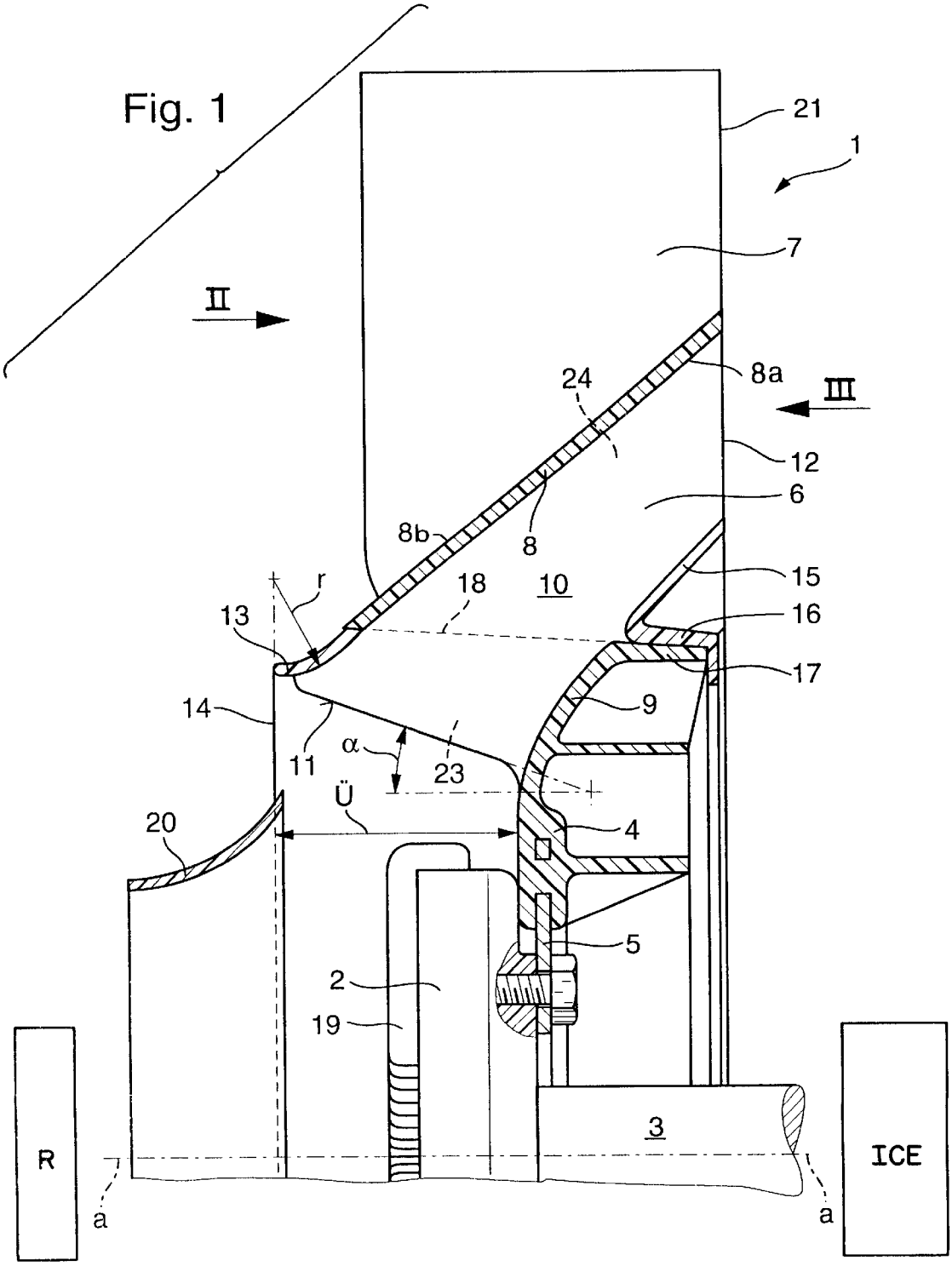
FIG. 1 shows a fan according to the invention having radial and axial blade sets rotatably driven by a fluid friction coupling.

FIG. 1 shows a fan 1 rotatably driven via a fluid friction coupling 2 by a drive shaft 3. The drive may be effected by any source of torque so as to generate air movements such as that required through a heat exchanger. In preferred embodiments, the drive may be effected by an internal-combustion engine ICE of a motor vehicle (not shown), with the fan 1 arranged behind a radiator R for cooling the internal-combustion engine ICE.

The fan 1 is produced essentially as a one-piece injection-molded article having in its radially inner region a hub 4. A metallic fastening flange 5 may be set in the hub 4 during molding to provide a connection to the output part of the fluid friction coupling 2.

The fan 1 has two different sets of blades: a first set of radial blades 6, and a second set of axial blades 7. The radial blades 6 extend from the interior face 8*a* of a conical annulus 8 toward the axis of rotation a—a, and the axial blades 7 extend radially outward from an exterior face 8*b* of the conical annulus 8. The conical annulus 8 separates the radial blades 6 and the axial blades 7 from one another.

The radial blades 6, together with the interior face 8*a* of the conical annulus a and a conical section 9 of the hub 4 define radial flow passages 10. The inlet to each radial flow passage 10 is further defined by a leading edge 11 of each radial blade 6, and the outlet from each radial flow passage 10 is further defined by a trailing edge 12 of each radial blade 6. In this disclosure, the terms "leading" or "upstream", and "trailing" or "downstream" describe features that initially and finally, respectively, participate in the movement of air. For technical reasons related to the injection-molding process—as explained in detail below—the conical annulus 8 docs not project as far forward axially as the leading edges 11.

A nozzle ring 13 having a cross-section with a radius of curvature r connects to the leading edge 11 of the radial blades 6 and defines an inlet plane 14 In preferred embodiments of the present invention, the cross-section of nozzle ring 13 at the inlet plane has a tangent that is generally parallel to the axis of rotation a—a.

Figure 7:
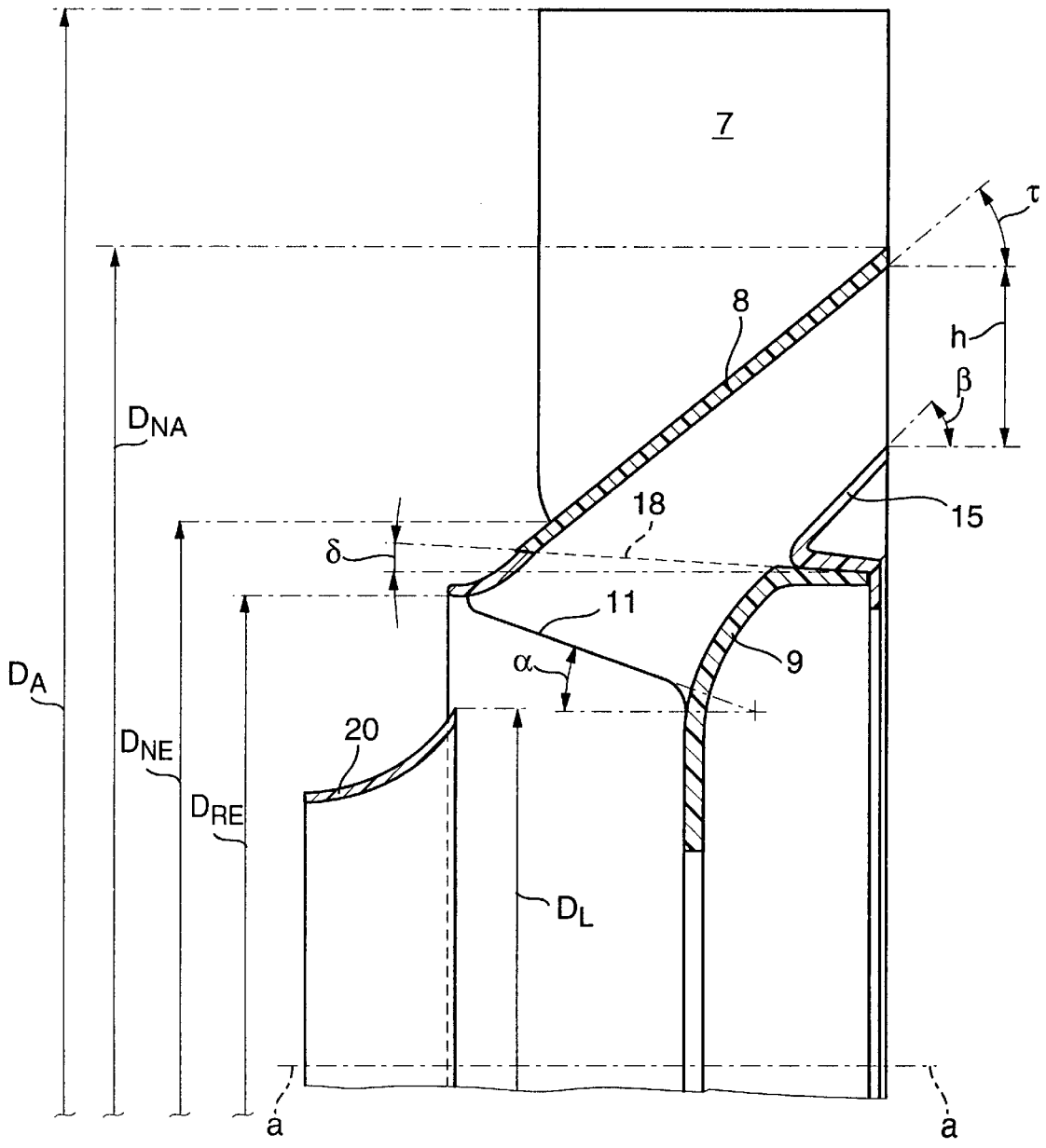
FIG. 7 shows the fan with its characteristic dimensions.

In a similar manner, an extension ring 15, which forms a continuation of the conical section 9, is mounted on the fan hub 4. The extension ring 15 is attached from the trailing edge side of the radial blades 6. The extension ring 15 includes a cylindrical part 16 fastened oil a cylindrical section 17 of the hub 4. Referring also to FIG. 7, the conicity of the extension ring 15, i.e. the angle $\beta$ with respect to the axis of rotation a—a, is designed to be slightly greater than the conicity of the conical annulus 8, i.e. the angle $\tau$ with respect to the axis of rotation a—a Thus, a conical constriction, which avoids flow separation, is obtained in the direction of flow in the flow passages 10.

Shown by a broken line in the flow passage 10 is a parting line 18, which runs nearly parallel to the axis (also see FIG. 7). The inside radius of the leading edge of the conical annulus 8 is generally equivalent to the corresponding radial spacing between the parting line 18 and the axis of rotation a—a. Also, the outside radius of the cylindrical section 17 is generally equivalent to the corresponding radial spacing between the parting line 18 and the axis of rotation a—a. This parting line 18, which is provided for reasons concerning the ejection of the radial blades 6 from a mold, will be explained in more detail below.

The leading edges 11 of the set of radial blades 6 define an imaginary conical surface that opens in the opposite direction with respect to the conical annulus 8, the conical section 9 and the extension ring 15. The conicity of the imaginary conical surface, i.e. the angle a with respect to the axis of rotation a—a (FIG. 7), is oblique, i.e. $0° < \alpha \leqq 45°$. Moreover, the leading edges 11 project forward axially from the hub 4 a distance Ü.

The fluid Friction coupling 2 is arranged in the region defined by the leading edges 11. On its front side, the fluid friction coupling 2 has radially projecting cooling ribs 19, which produce radially directed air flow. In preferred embodiments of the invention, an air-guide ring 20 is arranged upstream of the airflow impinging on the fluid friction coupling 2. The air-guide ring 20 may, for example, be fixed with respect to the radiator R or to a radiator frame (not shown). The air-guide ring 20 has a diameter that opens in the direction of air flow, so that it acts as a diffuser for air passing through the air-guide ring 20 and impinging on the fluid friction coupling 2, and as a deflector distributing the air flow striking the inlet edges 11. Thus, stable and effective flow is obtained for the air incident on and over the coupling 2, and for the air to the radial blades 6.

The axial blades 7 are designed in a manner known per se. The trailing edge 21 of the axial blades 7 is flush with the trailing edge 12 of the radial blades 6. The configuration of the conical annulus 8 supporting the axial blades 7 enhances the semi-axial flow prevailing in various installations of the fan according to the present invention.

Figure 2:
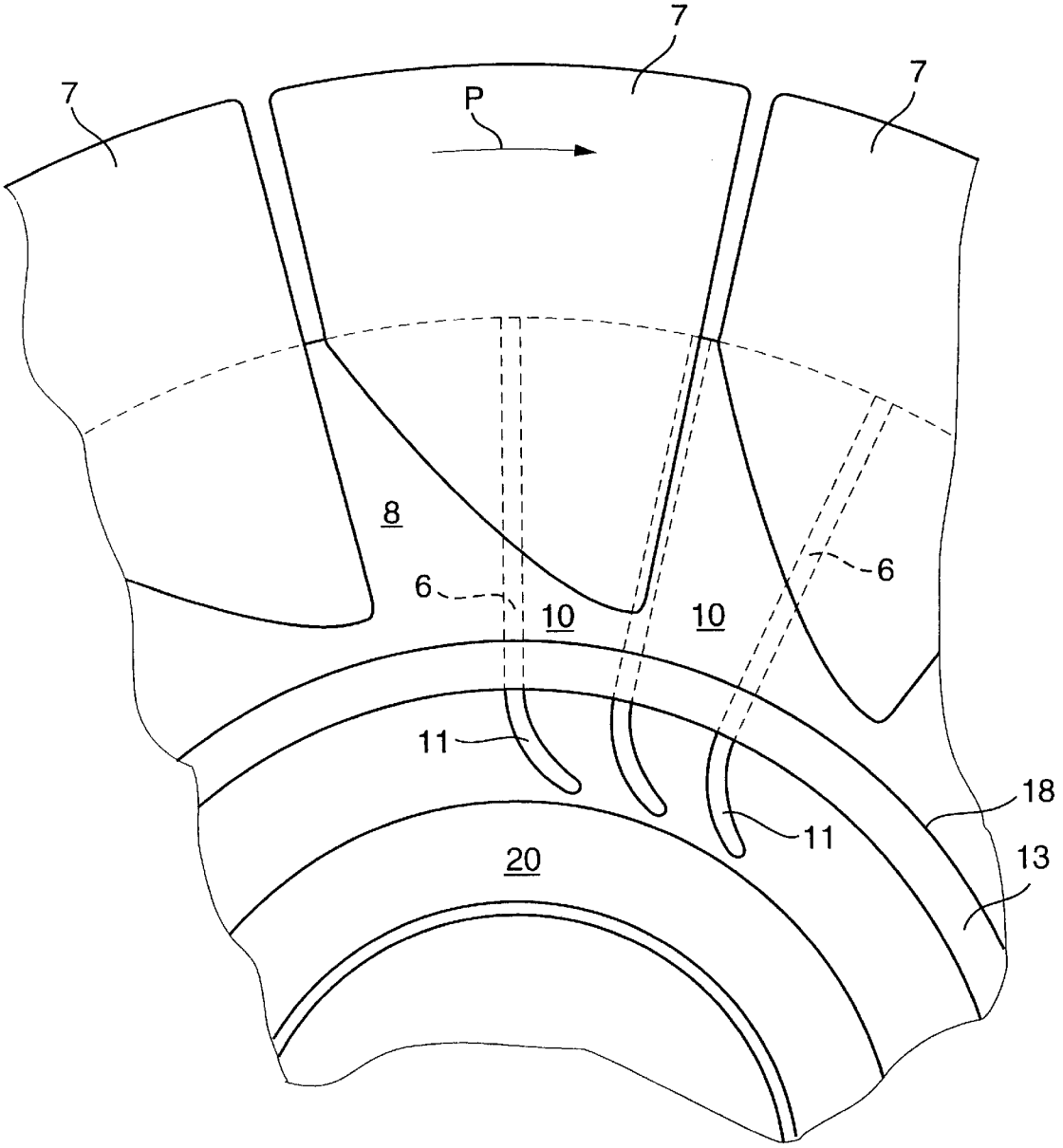
FIG. 2 shows a partial view of the fan according to FIG. 1 in direction II.

FIG. 2 is a partial view, without the fluid friction coupling 2, of an embodiment of the fan according to FIG. 1 in direction II, i.e. toward the incident-flow side of the fan 1. The leading edges 11 and segments 23 of the radial blades 6 lying radially inside the parting line 18, i.e. radially proximal with respect to the axis of rotation a—a, are curved in the direction of rotation P. Radially outside the parting line 18 (depicted as a circle), i.e. radially distal with respect to the axis of rotation a—a, segments 24 of the radial blades 6 run in a straight, substantially radial direction. In order to minimize flow looses in the radial flow passages 10, the curvature of each proximal segment 23 of the radial. blade 6 may also extend radially outward beyond the parting line 18, with the radially distal segments 24 of the radial blades 6 being correspondingly shortened.

Figure 3:
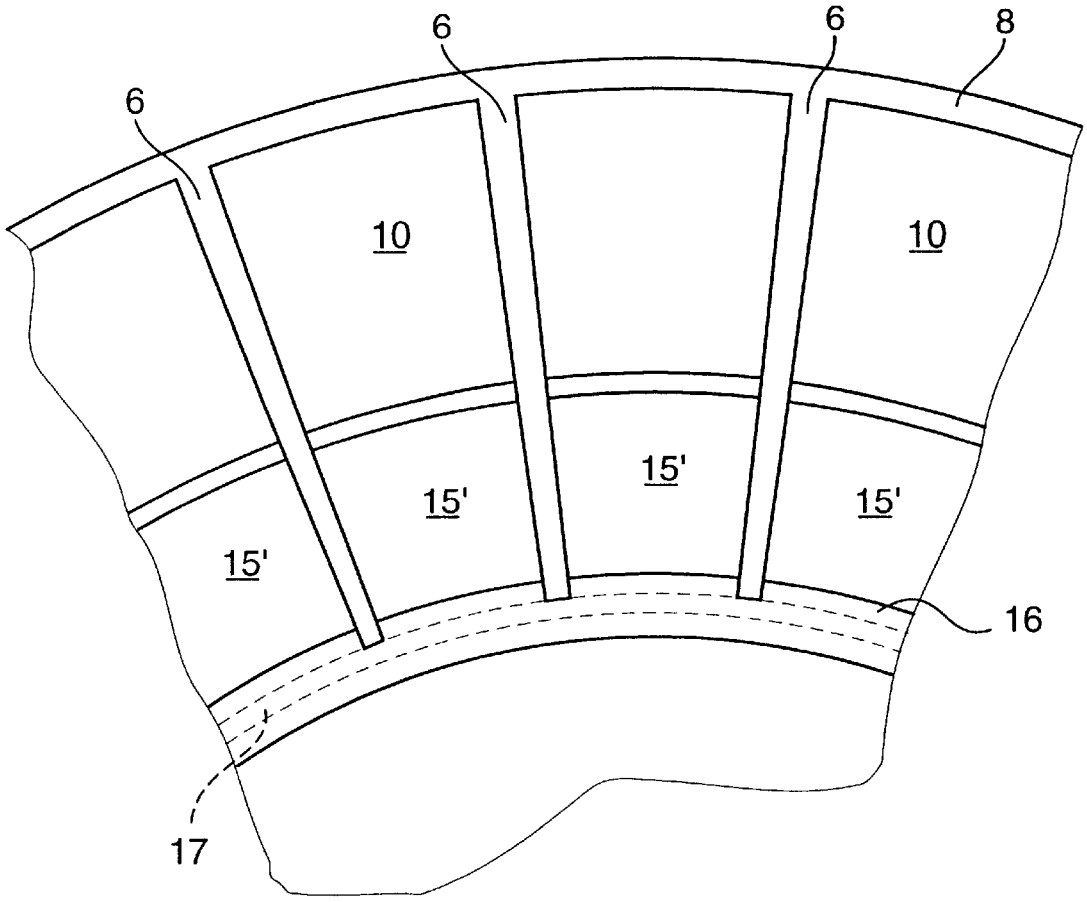
FIG. 3 shows a partial view of the fan according to FIG. 1 in direction III.

FIG. 3 shows a partial view, without the set of axial blades 7, of an embodiment of the fan according to FIG. 1 in direction III The view shows the outlet cross-sections of the flow passages 10, which are closed off to the radially outer side by the interior face 8*a* of the conical annulus 8, and are divided from one another by the radial blades 6. The radially inner part of the flow passages 10 is obscured by individual segments 15' arranged between the radial blades 6. The segments 15' are formed between slots accommodating the radial blades 6 and are part of the extension ring 15.

Figure 4:
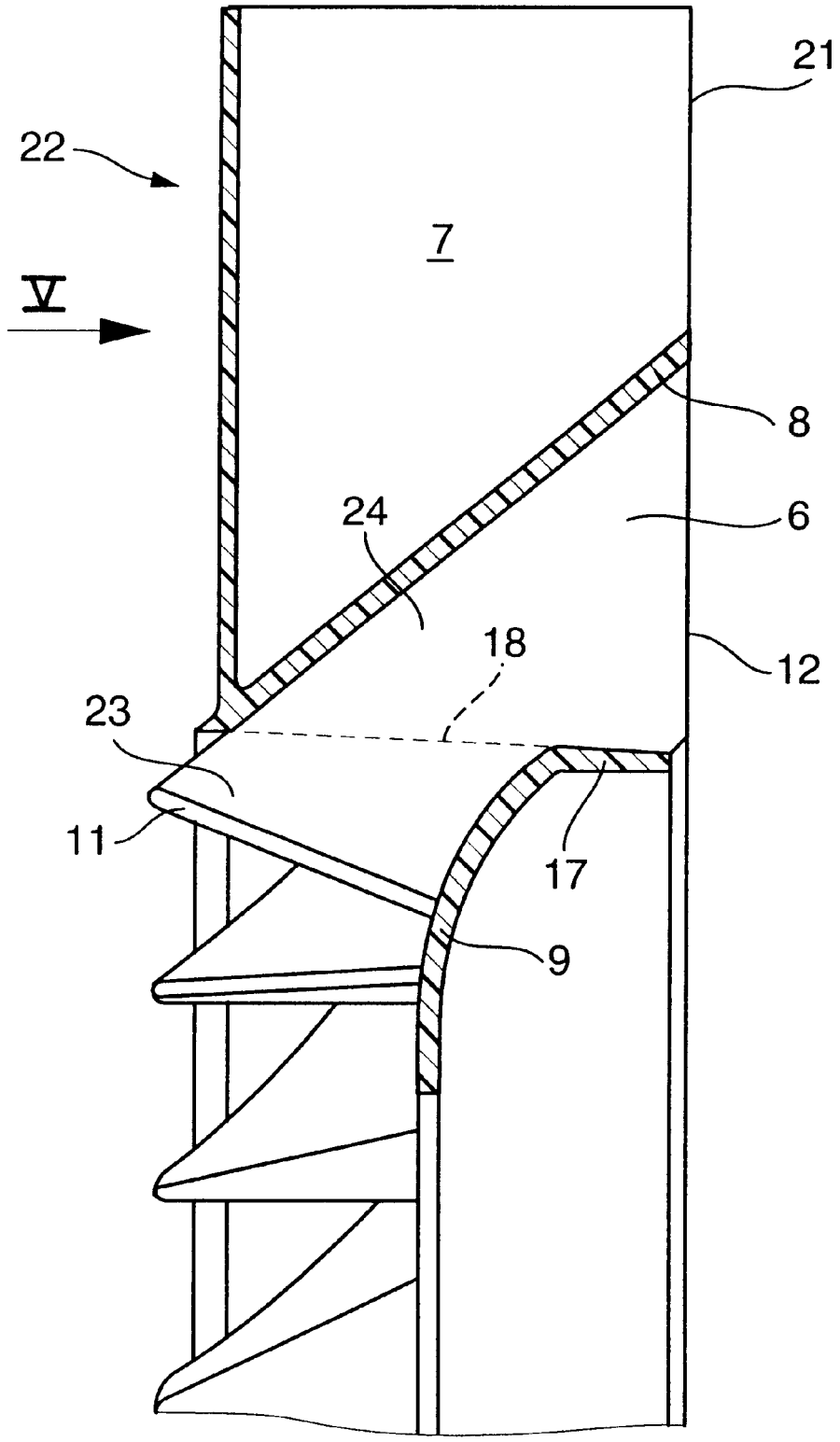
FIG. 4 shows the fan according to the invention as a one-piece injection-molded article.

FIG. 4 shows the basic body 22 of the fan 1 as it is produced in the form of a one-piece injection-molded article and removed from the mold. Accordingly, the nozzle ring 13 and the extension ring 15 are not illustrated. Further, the hub 4 has been simplified and shows only the conical section 9 and the cylindrical section 17. The basic body 22 consists of the conical annulus 8 and the conical section 9, which runs conically or with a slight curvature, the set of radial blades 6 and the set of axial blades 7. The radial blades 6 between the conical annulus 8 and the conical section 9 are demolded along the parting line 18 in opposite axial directions, i.e. the portion of the mold (not shown) forming the radially distal segments 24 is moved rearward, and the portion of the mold (not shown) forming the radially proximal segments 23 is moved forward. This assumes that the suction-side and pressure-side surfaces of the radially proximal segments 23 are lateral areas of a cylinder, with The cylindrical axis being parallel to the axis of rotation a—a. Due to the molding considerations, the basic body 22 is not molded in one-piece with the continuations of the conical annulus 8 and the conical section 9 formed by the nozzle ring 13 and the extension ring 15, respectively. In preferred embodiments of the invention, the radially inward portions of the radial blades 6 are integrally molded to the cylindrical section 17 in addition to the conical section 9, for increased strength.

Figure 5:
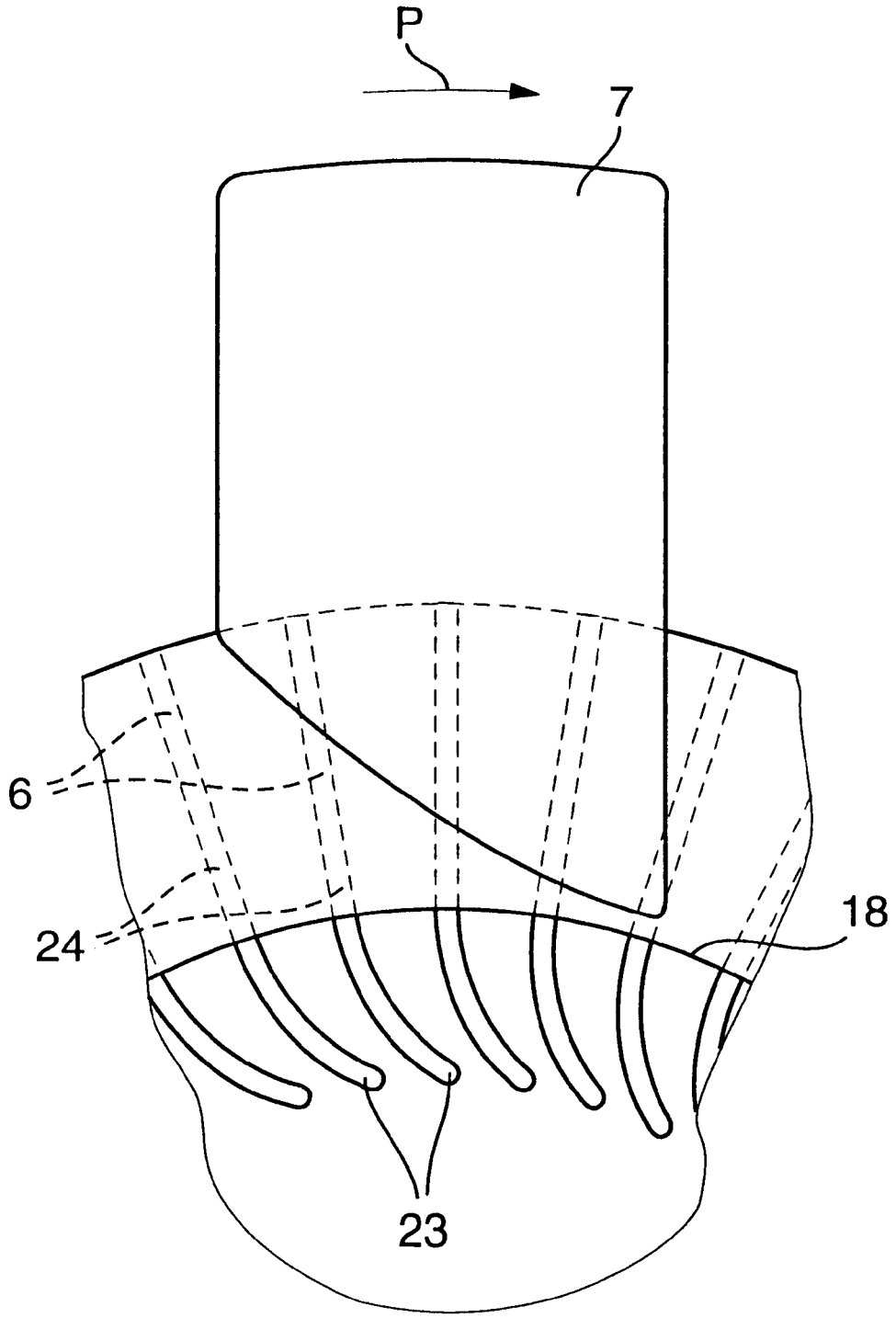
FIG. 5 shows a view of the fan according to FIG. 4 in direction V.

FIG. 5 shows a partial view of the basic body 22 as viewed in direction V of FIG. 4. In contrast to FIG. 2, only a portion of the radially proximal segments 23 lying inside the parting line 18 are curved in the direction of rotation P. The radially distal segments 24 lying outside the parting line 18 are shown as having a straight, radial orientation. However, the radially distal segments 24 may alternatively be inclined (a feature which is not shown) relative to diametral planes including the axis of rotation a—a, and tangentially adjoin the radially proximal segments 23.

Figure 6:
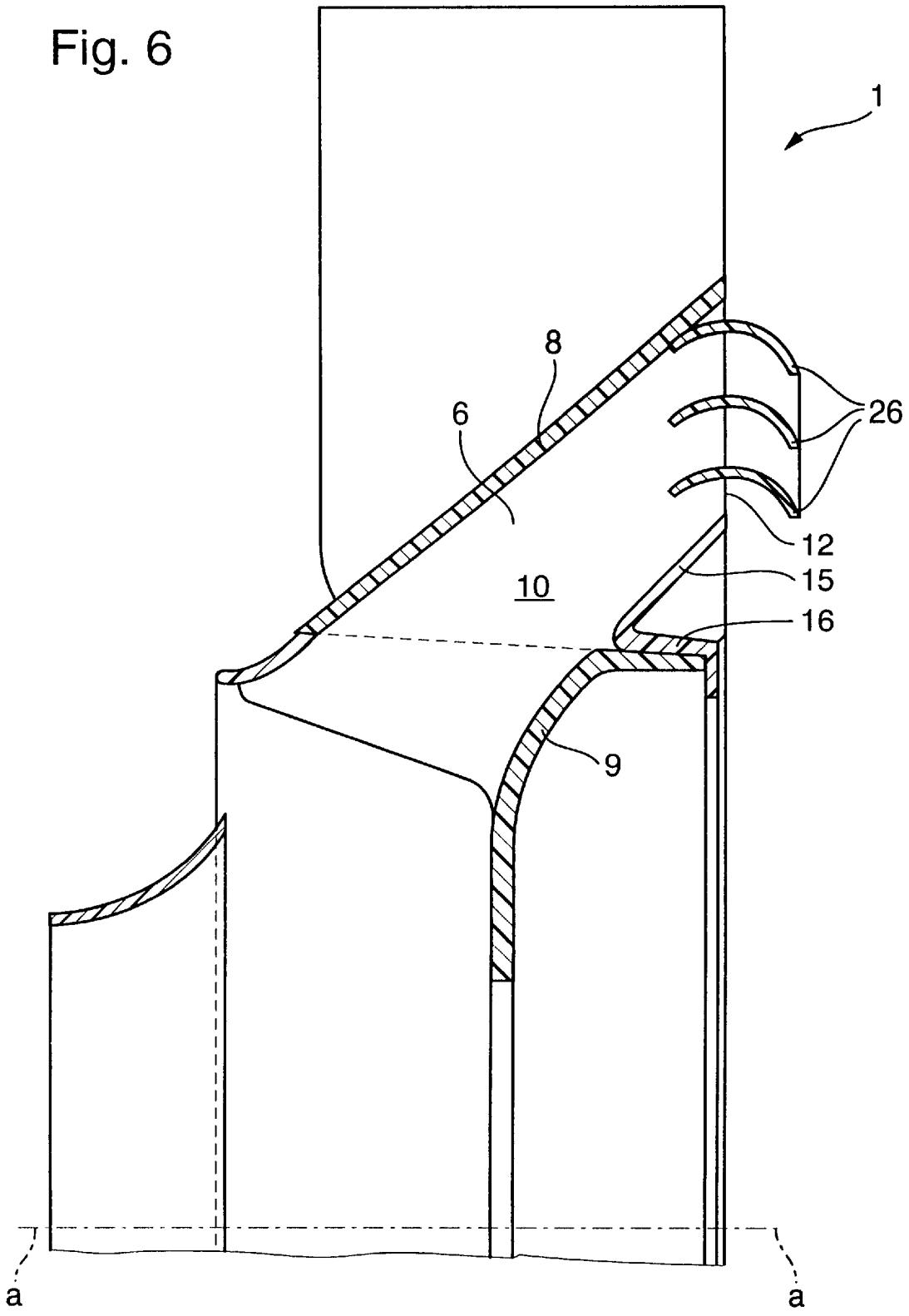
FIG. 6 shows the fan with guide device in the outlet region of the radial blades.

FIG. 6 shows a modification to preferred embodiments of the fan 1 according to the present invention. Specifically, at least one air-deflecting blade 26 (three are shown) is positioned for deflecting at least a portion of the outflow air from a flow passage 10 in the direction of the axis of rotation a—a. The air-deflecting blades 26 are only shown schematically here: they are distributed in spaced segments around the annular air outflow from the combination of all the flow passages 10. The air-deflecting blades 26 may either extend into the radial blades 6 and be connected to the fan 1, or be attached behind the outlet edge 12 separately from the fan 1, e.g. with respect to the engine ICE. The air-deflecting blades 26 avoid a build-up of heat between the rear side of the tan and the front side of the engine ICE by deflecting air radially in the direction of the axis of rotation a—a. Thus, heat dissipation is ensured from the radially inner region behind the fan 1, including the rear-side the fluid friction coupling 2 and the engine ICE.

FIG. 7 illustrates a few characteristic dimensions, such as diameters and angles, with respect to the air moving system according to the present invention.

The parting line 18 does not run exactly parallel to the axis of rotation a—a, but at an angle $\delta$ of approximately 3–4°, the so-called draw. The angles $\alpha$, $\beta$ and $\tau$ designate the conicity with respect to the axis of rotation a—a of the imaginary conical surface defined by the leading edges 11, the extension ring 15, and the conical annulus 8, respectively. According to the invention, $\beta>\tau$.

The following diameter designations are illustrated:

$D_A$ is the maximum diameter of the axial blades 7;

$D_{NE}$ is the minimum diameter of the axial blades 7;

$D_{NA}$ is the minimum diameter at the trailing edge of the axial blades 7;

$D_{RE}$ is the diameter at the leading edge of the nozzle ring 13; and $D_L$ is the maximum diameter of the air-guiding ring 20.

Additionally, h denotes the radial length of an radial blade 6 at its trailing edge, $Z_R$, and $Z_A$ respectively denote the number of radial blades 6 and axial blades 7, and $t_{NE}$ denotes the minimum circumferential spacing between axial blades 7. Circumferential spacing is calculated according to the following formula:

$$t = \frac{(\pi D)}{Z}$$

According to preferred embodiments of the invention, the following ratios are specified:

$t_{NE}:D_{NE}=0.15$ to 0.30;

$D_{NE}:D_A=0.45$ to 0.60;

$D_{RE}:D_A=0.40$ to 0.53;

$D_{NA}:D_A=0.63$ to 0.80; and $h:D_A=0.03$ to 0.08.

An example of a preferred embodiment of a fan according to the invention could have, for instance, the following characteristics:

$D_{NE}=400$ mm;

$D_A=750$ mm;

$Z_A=12$.

Thus, the value $t_{NE}$ is computed as:

$$t_{NE} = \frac{(\pi D_{NE})}{Z_A} = \frac{(400\pi)}{12} = 105 \text{ mm}$$

and, $t_{NE}:D_{NE}=0.26$.

Thus, the hub ratio is:

$D_{NE}:D_A=0.53$.

For the number of radial blades $Z_R$, a multiple of the number of axial blades $Z_A$ is proposed for strength reasons:

$2\ Z_A \leqq Z_R \leqq 5\ Z_A$.

A fan 1 according to the present invention will be able to handle tensile loads on the conical annulus 8 caused by the set of axial blades 7. For hydrodynamic reasons, care is to be taken to ensure that the pressures at the outlets of the radial blades 6 and the axial blades 7 are generally equivalent.

Additional advantages and modifications will readily occur to those skilled in the art. Therefore, the invention in its broader aspects is not limited to the specific details, and representative devices, shown and described herein. Accordingly, various modifications may be made without departing from the spirit and scope of the general inventive concept as defined by the appended claims and their equivalents.

German Patent Application 197 10 606.4, filed Mar. 14, 1997, is hereby incorporated by reference.

What is claimed is:

1. A fan for moving air through a heat exchanger, comprising:

a conical annulus having an axis of rotation;

a first set of fan blades extending from an interior face of said conical annulus toward said axis of rotation;

a second set of fan blades extending from an exterior face of said conical annulus away from said axis of rotation, wherein, upon rotation in a direction, said first set of fan blades move the air generally radially with respect to said axis of rotation and said second set of fan blades move the air generally axially with respect to said axis of rotation;

a hub being supported for rotation on said axis of rotation and being concentrically fixed with respect to said conical annulus, said hub having a conical section connected to said first set of blades; and radial air flow passages defined by said first set of blades in combination with said interior face of said conical annulus and said conical section of said hub;

wherein leading edges of said first set of blades define an imaginary conical surface that is concentric with said axis of rotation, said imaginary conical surface opening oppositely with respect to said conical annulus and said conical section of said hub, wherein an angle formed between said imaginary conical surface and said axis of rotation is greater than 0° and less than or equal to about 45°; and wherein said leading edges project axially from said hub to said interior face of said conical annulus.

2. The fan as claimed in claim 1, wherein said hub, said conical annulus, and said first and second sets of fan blades are injection molded together in one-piece.

3. The fan as claimed in claim 2, wherein each blade of said first set of fan blades includes an imaginary parting line where the injection mold is separated, said imaginary parting lines being nearly parallel and radially spaced with respect to said axis of rotation.

4. The fan as claimed in claim 3, wherein said conical annulus has a leading edge with respect to the air movement having an inside radius equivalent to the corresponding radial spacing between said parting line and said axis of rotation.

5. The fan as claimed in claim 3, wherein said hub has a cylindrical section, said cylindrical section having an outside radius equivalent to the corresponding radial spacing between said parting lines and said axis of rotation.

6. The fan as claimed in claim 3, wherein an angle between said interior face of said conical annulus and said axis of rotation is less than an angle formed between said conical section of said hub and said axis of rotation.

7. The fan as claimed in claim 5, further comprising:

an extension ring continuing said conical section of said hub, said extension ring being supported on said cylindrical section of said hub.

8. The fan as claimed in claim 1, wherein each blade of said first set of fan blades has a radially distal segment that extends substantially radially with respect to said axis of rotation, and a radially proximal segment that curves in said direction of rotation.

9. The fan as claimed in claim 1, further comprising:

a nozzle ring forming an air inlet on said conical annulus, said nozzle ring having a curved cross-section such that its tangent at a leading edge is parallel with said axis of rotation.

10. The fan as claimed in claim 1, further comprising:

an extension ring extending said conical section of said hub, said extension ring being supported on a generally cylindrical section of said hub.

11. The fan as claimed in claim 10, wherein said conical annulus has a leading edge with respect to the air movement having an inside radius generally equivalent to an outside radius of said cylindrical section of said hub.

12. The fan as claimed in claim 1, further comprising:

at least one air deflecting blade diverting a portion of the air moved by said first set of blades toward said axis of rotation.

13. The fan as claimed in claim 3, further comprising:

a nozzle ring forming an air inlet of said conical annulus, said nozzle ring having a radius at its connection to said conical annulus equivalent to the corresponding radial spacing between said parting lines and said axis of rotation.

14. The fan as claimed in claim 1, wherein a ratio between a minimum circumferential spacing between blades of said second set of blades is ($t_{NE}$) and a minimum diameter of said second set of blades ($D_{NE}$) has a range:

$0.15 \leqq t_{NE}:D_{NE} \leqq 0.30$.

15. The fan as claimed in claim 1, wherein a ratio between a minimum diameter of said second get of blades ($D_{NE}$) and a maxi mum diameter of said second set of blades ($D_A$) has a range:

$0.45 \leqq D_{NE}:D_A \leqq 0.60$.

16. The fan as claimed in claim 9, wherein a ratio between a diameter of said leading edge of said nozzle ring ($D_{RE}$) and a maximum diameter of said second set of blades ($D_A$) has a range:

$D_{RE}:D_A=0.40$ to $0.53$.

17. The fan as claimed in claim 1, wherein a ratio between a minimum diameter of a trailing edge with respect to air movement of said second set of blades ($D_{NA}$) and a maximum diameter of said second set of blades ($D_A$) has a range:

$D_{NA}:D_A=0.63$ to $0.80$.

18. The fan as claimed in claim 1, wherein a ratio between a radial length of a trailing edge with respect to air movement of said first set of blades (h) and a maximum diameter of said second set of blades ($D_A$) has a range:

$h:D_A=0.03$ to $0.08$.

19. The fan as claimed in claim 1, wherein a number of blades of said first set of blades ($Z_R$) with respect to a number of blades of said second set of blades ($Z_A$) has a range:

$2Z_A \leqq Z_R \leqq 5Z_A$.

20. A system for moving air through a radiator for an internal combustion engine, comprising:

a conical annulus having an axis of rotation;

a hub being supported for rotation on said axis of rotation and being concentrically fixed with respect to said conical annulus;

a first set of fan blades connecting an interior face of said conical annulus to said hub; and a second set of fan blades extending from an exterior face of said conical annulus away from said axis of rotation; and at least one air deflecting blade diverting toward said axis of rotation a portion of the air moved by said first set of blades; and wherein said at least one air deflecting blade is adapted to be supported with respect to the engine;

a fluid friction clutch adapted for rotatably coupling the engine to said hub;

wherein, upon rotation in a direction, said first set of fan blades move the air generally radially with respect to said axis of rotation and said second set of fan blades move the air generally axially with respect to said axis of rotation.

21. The system as claimed in claim 20, further comprising:

an air-guiding ring adapted to be supported with respect to the radiator and generally coaxially aligned with said axis of rotation;

wherein said air-guide ring has a curved cross-section diffusing the air passing through said air-guide ring and deflecting the air passing around said air-guide ring, the air passing through the air-guide ring impinges on said fluid friction coupling, and the air passing around said air-guide ring is distributed to said first set of blades.

22. A fan for moving air, comprising:

a conical annulus having an axis of rotation;

a hub being supported for rotation on said axis of rotation and being concentrically fixed with respect to said conical annulus;

a plurality of radial fan blades extending generally radially from an interior face of said conical annulus toward said axis of rotation, each of said plurality of radial fan blades having a leading edge with respect to the air movement, said leading edges extending axially from said hub to said conical annulus and extending obliquely with respect to said axis of rotation; and a plurality of axial fan blades extending radially from an exterior face of said conical annulus away from said axis of rotation;

wherein said leading edges define an imaginary conical surface opening in an opposite axial direction relative to said conical annulus; and wherein said leading edges extend axially beyond a leading edge of said axial fan blades.

* * * * *